US011377990B2

(12) United States Patent
Toichi et al.

(10) Patent No.: US 11,377,990 B2
(45) Date of Patent: Jul. 5, 2022

(54) EXHAUST PIPE

(71) Applicant: FUTABA INDUSTRIAL CO., LTD., Okazaki (JP)

(72) Inventors: Shinnosuke Toichi, Okazaki (JP); Takeshi Osanai, Okazaki (JP); Yoshiaki Kataoka, Okazaki (JP); Hayato Tawada, Okazaki (JP); Katsuhiko Kainuma, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 398 days.

(21) Appl. No.: 16/728,896

(22) Filed: Dec. 27, 2019

(65) Prior Publication Data

US 2020/0217231 A1 Jul. 9, 2020

(30) Foreign Application Priority Data

Jan. 9, 2019 (JP) ..... JP2019-001929

(51) Int. Cl.
*F01N 1/02* (2006.01)
*F01N 13/14* (2010.01)
(Continued)

(52) U.S. Cl.
CPC ..... *F01N 1/02* (2013.01); *F01N 13/08* (2013.01); *F01N 13/143* (2013.01); *F01N 2470/24* (2013.01); *G10K 11/172* (2013.01)

(58) Field of Classification Search
CPC .... F01N 13/082; F01N 13/141; F01N 13/143; F01N 2470/24
See application file for complete search history.

(56) References Cited

U.S. PATENT DOCUMENTS 5,606,857 A * 3/1997 Harada ..... F01N 13/1811 60/322
2006/0283002 A1 12/2006 Kuroda et al.
2018/0266301 A1 9/2018 Higashino et al.

FOREIGN PATENT DOCUMENTS

DE 2220921 B1 * 11/1973
JP 06299848 A * 10/1994
(Continued)

OTHER PUBLICATIONS

Notice of Reasons for Refusal for Japanese Patent Application No. 2019001929, dated Nov. 24, 2020, 8 pages.
(Continued)

*Primary Examiner* — Jonathan R Matthias
(74) *Attorney, Agent, or Firm* — Withrow & Terranova, P.L.L.C.; Vincent K. Gustafson

(57) ABSTRACT

An exhaust pipe with a double pipe structure that can reduce generation of a turbulent flow of exhaust gases is provided. In one aspect of the present disclosure, the exhaust pipe includes a double pipe and a retention member. The double pipe includes an inner pipe and an outer pipe. The retention member is disposed in a gap provided between an outer circumferential surface of the inner pipe and an inner circumferential surface of the outer pipe. The retention member is disposed at at least one end of the double pipe. At the end of the double pipe where the retention member is disposed, a radial clearance between the outer circumferential surface of the inner pipe and the inner circumferential surface of the outer pipe at an opening of the inner pipe is smaller than the radial clearance in an arrangement area where the retention member is disposed.

9 Claims, 8 Drawing Sheets

(51) Int. Cl.
*F01N 13/08* (2010.01)
*G10K 11/172* (2006.01)

(56) References Cited

FOREIGN PATENT DOCUMENTS

| | | | |
|---|---|---|---|
| JP | H08004524 | A | 1/1996 |
| JP | 2002227642 | A | 8/2002 |
| JP | 2005207388 | A | 8/2005 |
| JP | 2006348864 | A | 12/2006 |
| WO | 2017126508 | A1 | 4/2018 |

OTHER PUBLICATIONS

Notice of the First Patent Examination Opinion for Chinese Patent Application No. 202010015869.9 dated Jun. 2, 2021, 15 pages.

* cited by examiner

EXHAUST PIPE

CROSS-REFERENCE TO RELATED APPLICATIONS

The present application claims the benefit of Japanese Patent Application No. 2019-001929 filed on Jan. 9, 2019 with the Japan Patent Office, the entire disclosure of which is incorporated herein by reference.

BACKGROUND

The present disclosure relates to an exhaust pipe.

A known exhaust system for automobiles includes a sub-muffler provided between a catalyst, disposed upstream of a flow path of exhaust gases, and a main muffler, disposed downstream of the flow path of the exhaust gases.

For this sub-muffler, an exhaust pipe having a double pipe structure including an inner pipe and an outer pipe is used. Such an exhaust pipe exhibits a muffling effect due to a gap between the inner pipe and the outer pipe. In the exhaust pipe, hot exhaust gases flow inside the inner pipe, thereby causing a difference in thermal expansion between the inner pipe and the outer pipe.

To absorb the difference in thermal expansion between the inner pipe and the outer pipe, an exhaust pipe has been invented in which a ring-like holding member is disposed between the inner pipe and the outer pipe at one end of the double pipe (see, for example, Japanese Unexamined Patent Application Publication No. 2002-227642).

The holding member of the aforementioned exhaust pipe is slidably disposed relative to the inner pipe and the outer pipe, and thus is not fixed to neither of the inner pipe and the outer pipe. In the technique of the above-described publication, two projections are provided by pressing the inner pipe such that the holding member is interposed between the projections in order to inhibit the holding member from falling out from the ends of the double pipe.

SUMMARY

At an end of the above-described double pipe, exhaust gases that have flown past an end of the inner pipe spread into the outer pipe. Then, if the difference between the length of the inner pipe and that of the outer pipe in the radial direction is large, in other words, if the difference in level between the inner pipe and the outer pipe is large, a turbulent flow of the exhaust gases and air flow noises tend to be caused.

It is desirable that one aspect of the present disclosure provides an exhaust pipe with a double pipe structure that can reduce generation of the turbulent flow of exhaust gases.

One aspect of the present disclosure provides an exhaust pipe comprising a double pipe and a retention member. The double pipe comprises an inner pipe through which exhaust gases pass, and an outer pipe disposed so as to surround an outer circumferential surface of the inner pipe. The retention member is disposed in a gap provided between the outer circumferential surface of the inner pipe and an inner circumferential surface of the outer pipe. The retention member is disposed at at least one of a first end or a second end of the double pipe.

Moreover, at the at least one of the first end or the second end of the double pipe where the retention member is disposed, a radial clearance between the outer circumferential surface of the inner pipe and the inner circumferential surface of the outer pipe at an opening of the inner pipe is smaller than the radial clearance in an arrangement area where the retention member is disposed.

This structure can inhibit the retention member from falling off the end of the double pipe due to the clearance between the inner pipe and the outer pipe at the opening of the inner pipe being smaller than the radial clearance in the arrangement area. This structure can also reduce the difference in level in the radial direction between the inner pipe and the outer pipe at the end of the double pipe. Due to this structure, generation of the turbulent flow of the exhaust gases can be reduced while having the retention member in the double pipe. As a result, production of the air flow noises can be reduced.

In one aspect of the present disclosure, at the at least one of the first end or the second end of the double pipe where the retention member is disposed, an outer diameter of the inner pipe at the opening may be larger than an outer diameter of the inner pipe in the arrangement area. This structure can easily and reliably make the clearance at the opening of the inner pipe smaller than the radial clearance in the arrangement area.

In one aspect of the present disclosure, at the at least one of the first end or the second end of the double pipe where the retention member is disposed, an inner diameter of the outer pipe at a position where the outer pipe coexists with an opening of the inner pipe may be smaller than an inner diameter of the outer pipe in the arrangement area. This structure can also easily and reliably make the clearance at the opening of the inner pipe smaller than the radial clearance in the arrangement area.

In one aspect of the present disclosure, at the at least one of the first end or the second end of the double pipe where the retention member is disposed, the outer diameter of the inner pipe in the arrangement area may be larger than an outer diameter of the inner pipe in an area located inside relative to the arrangement area along an axis of the inner pipe. This structure can more reliably reduce generation of the turbulent flow of the exhaust gases.

In one aspect of the present disclosure, the retention member may be disposed at a downstream end of the double pipe in a flow direction of the exhaust gases. Resonance pipes may be formed on an upstream side of the double pipe in the flow direction of the exhaust gases. A resonance chamber may be formed between the retention member and the resonance pipes.

In one aspect of the present disclosure, the retention member may be disposed at an upstream end of the double pipe in a flow direction of the exhaust gases. Resonance pipes may be formed on a downstream side of the double pipe in the flow direction of the exhaust gases. A resonance chamber may be formed between the retention member and the resonance pipes.

BRIEF DESCRIPTION OF THE DRAWINGS

Some embodiments of the present disclosure will be described hereinafter by way of example with reference to the accompanying drawings, in which.

DETAILED DESCRIPTION OF EXEMPLARY EMBODIMENTS

1. First Embodiment

[1-1. Structure]

Figure 1:
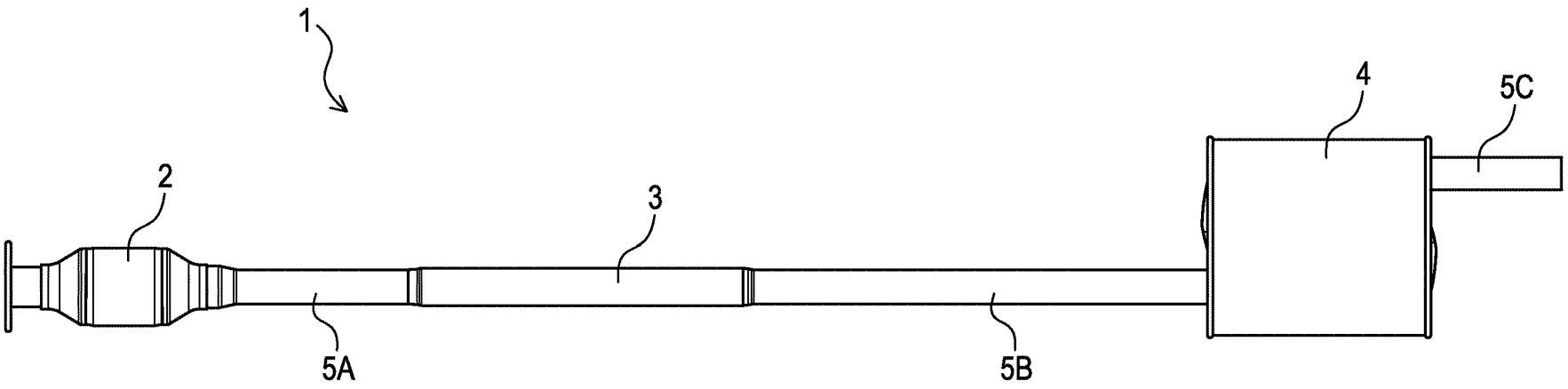
FIG. 1 is a schematic plane showing an exhaust system of an embodiment.

An exhaust system 1 shown in FIG. 1 forms an exhaust flow passage of an internal combustion engine. The exhaust system 1 comprises a catalyst converter 2, an exhaust pipe 3 which is a sub-muffler, and a main muffler 4.

The internal combustion engine in which the exhaust system 1 is employed is not limited to a specific type. Examples of the internal combustion engine include those used for transportation vehicles, such as automobiles, railroad vehicles, ships, and construction machines, and those used for power generation facilities for driving purpose or power generation purpose.

The catalyst converter 2 is configured to reform or collect environmental contaminants in the exhaust gases. The catalyst converter 2 includes, for example, a catalyst. The main muffler 4 is configured to further reduce noises produced by the exhaust gases passing through the exhaust pipe 3.

The catalyst converter 2 and the exhaust pipe 3 are connected by a first pipe 5A. The exhaust pipe 3 and the main muffler 4 are connected by a second pipe 5B. The exhaust gases that have passed through the main muffler 4 is discharged from a third pipe 5C.

The exhaust pipe 3 serves as a muffler in the exhaust system 1.

Figure 2A:
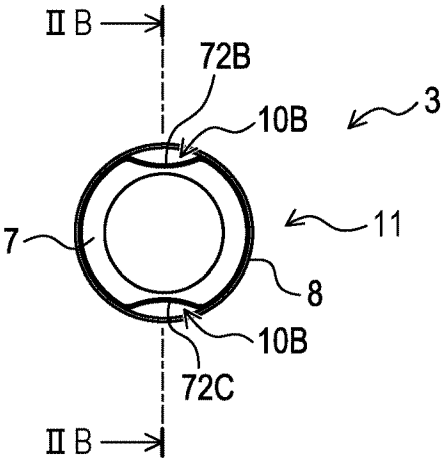
FIG. 2A is a schematic side view showing the exhaust pipe in FIG. 1 from a second end side.
Figure 2B:
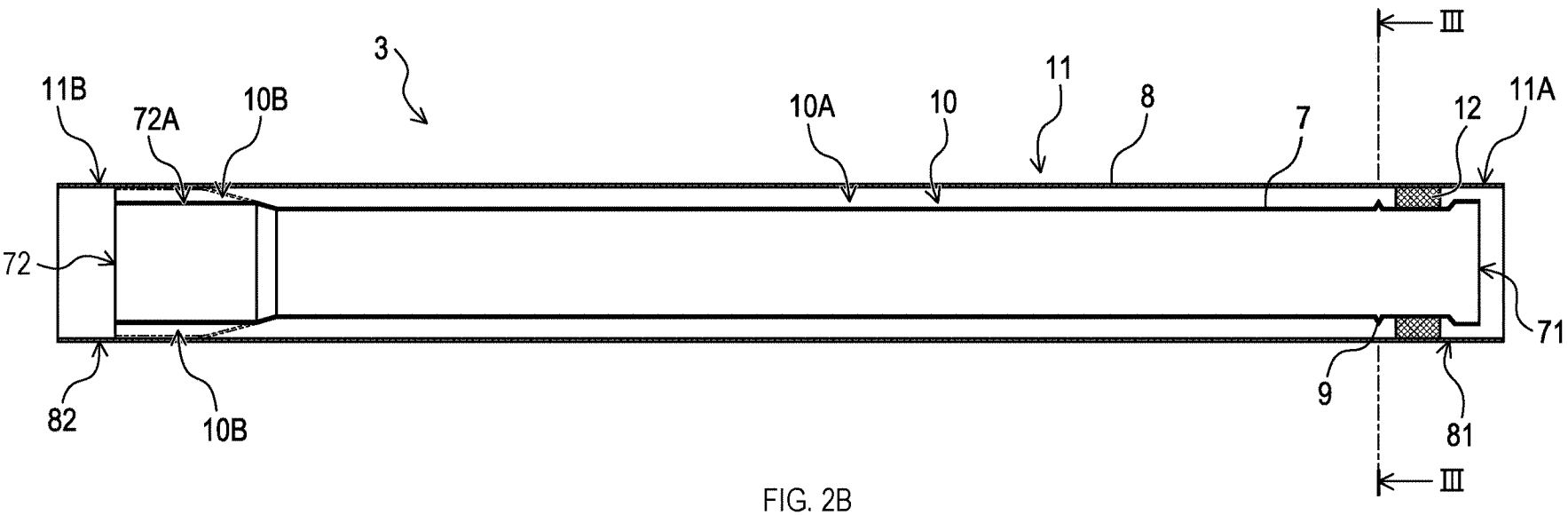
FIG. 2B is a schematic sectional view taken along a line IIB-IIB in FIG. 2A.

As shown in FIGS. 2A and 2B, the exhaust pipe 3 comprises a double pipe 11 and a retention member 12.

<Double Pipe>

The double pipe 11 comprises an inner pipe 7, an outer pipe 8, projections 9, and a gap 10.

<<Inner Pipe>>

The inner pipe 7 is a metal pipe in which the exhaust gases pass through. Specifically, the exhaust gases that have passed through the catalyst converter 2 are introduced into the inner pipe 7 from one of a first opening 71 and a second opening 72, and discharged from the opening on the opposite side.

In the vicinity of the first opening 71 of the inner pipe 7, the projections 9, which will be described below, are formed. The inner diameter of the first opening 71 of the inner pipe 7 is larger than the diameter of the inner pipe 7 in an arrangement area where the retention member 12, which will be described below, is disposed.

At the second opening 72 of the inner pipe 7, a fixed portion 72A is provided so as to be fixed to the inner circumferential surface of the outer pipe 8. The fixed portion 72A includes two concave portions 72B, 72C formed by a part of the wall of the inner pipe 7 being inwardly depressed. The concave portions 72B, 72C form openings that make the gap 10 and the second opening 72 of the inner pipe 7 communicated.

In other words, a part of the fixed portion 72A in the circumferential direction is spaced apart from the inner circumferential surface of the outer pipe 8. Moreover, the fixed portion 72A closes the gap 10 in the axial direction of the inner pipe 7 by means of a part of the fixed portion 72A excluding the concave portions 72B, 72C.

<<Outer Pipe>>

The outer pipe 8 is a metal pipe disposed to surround the outer circumferential surface of the inner pipe 7. The inner diameter of the outer pipe 8 is larger than the outer diameter of the inner pipe 7.

A first end 81 of the outer pipe 8 surrounds the first opening 71 of the inner pipe 7 and the projections 9. The retention member 12, which will be described below, is disposed inside of the first end 81. The first end 81 extends to the outside of the inner pipe 7 in the axial direction of the inner pipe 7 away from the longitudinal center of the inner pipe 7. The first end 81 forms a first end 11A of the double pipe 11.

A second end 82 of the outer pipe 8 surrounds the second opening 72 of the inner pipe 7. The second end 82 is joined with the outer circumferential surface of the inner pipe 7 (specifically, with the concave portions 72B, 72C) by, for example, welding. The second end 82 extends to the outside of the inner pipe 7 in the axial direction of the inner pipe 7. The second end 82 forms a second end 11B of the double pipe 11.

In the present embodiment, the outer pipe 8 is a straight pipe having a constant diameter. In other words, the inner diameter of the first end 81 of the outer pipe 8 and the inner diameter of the second end 82 are the same. Moreover, the central axis of the outer pipe 8 corresponds to the central axis of the inner pipe 7. Nevertheless, these central axes do not have to be coaxial.

<<Gap>>

The gap 10 is formed between the outer circumferential surface of the inner pipe 7 and the inner circumferential surface of the outer pipe 8. The gap 10 is a space defined by the outer circumferential surface of the inner pipe 7, the inner circumferential surface of the outer pipe 8, the fixed portion 72A, and the retention member 12.

The gap 10 comprises a resonance chamber 10A and two resonance pipes 10B. The resonance chamber 10A is formed between a part of the outer circumferential surface of the inner pipe 7 excluding the fixed portion 72A (in other words, a part of the double pipe 11 excluding the second end 11B) and the inner circumferential surface of the outer pipe 8. The two resonance pipes 10B are respectively formed between the concave portion 72B of the inner pipe 7 and the inner circumferential surface of the outer pipe, and between the concave portion 72C of the inner pipe 7 and the inner circumferential surface of the outer pipe.

The resonance pipes 10B communicate with the exhaust flow passage in the inner pipe 7, and the resonance chamber 10A communicates with the exhaust flow passage via the resonance pipes 10B, which makes the resonance pipes 10B and the resonance chamber 10A serve as a Helmholtz resonator.

<<Projections>>

The projections 9 are formed at a position on the inner pipe 7 located inside relative to the position of the retention member 12 in the axial direction toward the longitudinal center of the inner pipe 7, and protrude radially outwardly from the outer circumferential surface of the inner pipe 7. The projections 9 restrict inward movement of the retention member 12 in the axial direction of the inner pipe 7.

Figure 3:
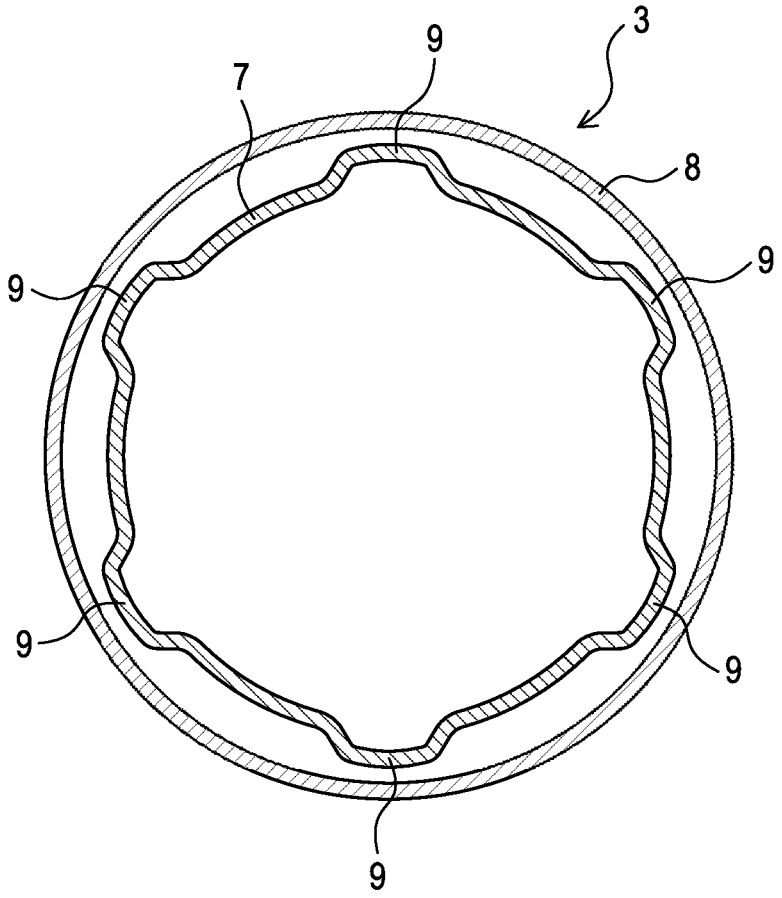
FIG. 3 is a schematic sectional view taken along a line in FIG. 2B.

As shown in FIG. 3, the exhaust pipe 3 comprises at least one projection 9. In a case where there is more than one projection, the projections 9 are spaced apart from each other in the circumferential direction. FIG. 3 shows an example in which six projections 9 are equidistantly disposed in the circumferential direction; nevertheless, the number of the projections 9 is not limited to six. Moreover, the intervals between two or more projections 9 do not have to be equal. Furthermore, the projections 9 may be wide in the axial direction of the double pipe 11. In other words, the projections 9 may extend along the axis of the double pipe 11. The projections 9 may have rounded shapes such as hemispheres, or may have angular shapes such as parallelepipeds.

<Retention Member>

As shown in FIG. 2B, the retention member 12 is disposed in the gap 10 at the first end 11A of the double pipe 11. Specifically, the retention member 12 is inserted between the outer circumferential surface of the inner pipe 7 and the inner circumferential surface of the outer pipe 8, but is not fixed to the inner pipe 7 and the outer pipe 8.

The retention member 12 is disposed entirely along the outer circumferential surface of the inner pipe 7 and the inner circumferential surface of the outer pipe 8 in the circumferential direction. In other words, the retention member 12 is disposed so as to substantially block the space between the inner pipe 7 and the outer pipe 8 in the axial direction of the inner pipe 7. To form a portion of the wall of the resonance chamber 10A, it is desirable that the retention member 12 is formed in a ring-like shape that can reduce the gap between the inner pipe 7 and the outer pipe 8. The retention member 12 may be provided with an opening/openings in a portion thereof in the circumferential direction to the extent that the function of the resonance chamber 10A is not impaired.

The retention member 12 is only required to be able to define the gap 10, that is, the resonance chamber 10A, and to be slidable relative to at least one of the inner pipe 7 or the outer pipe 8. Thus, the retention member 12 is not limited to a particular member. It is desirable that the retention member 12 is not breathable, but may be breathable to the extent that the function of the resonance chamber 10A is not impaired. The retention member 12 is preferably a metal wire mesh, for example. Due to the retention member 12 being slidably disposed in the space between the inner pipe 7 and the outer pipe 8, stress produced by the difference in thermal expansion between the inner pipe 7 and the outer pipe 8 is reduced.

The exhaust pipe 3 may be connected to the first pipe 5A at the first end 11A of the double pipe 11, that is, the first end 81 of the outer pipe 8, or may be connected to the first pipe 5A at the second end 11B of the double pipe 11, that is, the second end 82 of the outer pipe 8. In other words, the retention member 12 may be disposed at a downstream end of the double pipe 11 in the flow direction of the exhaust gases, or may be disposed at an upstream end of the double pipe 11 in the flow direction of the exhaust gases. Accordingly, a portion of the first end 81 that extends to the outside of the inner pipe 7 in the axial direction of the inner pipe 7 is connected to the first pipe 5A or the second pipe 5B (see FIG. 4A).

<Clearance Between Inner Pipe and Outer Pipe>

Figure 4A:
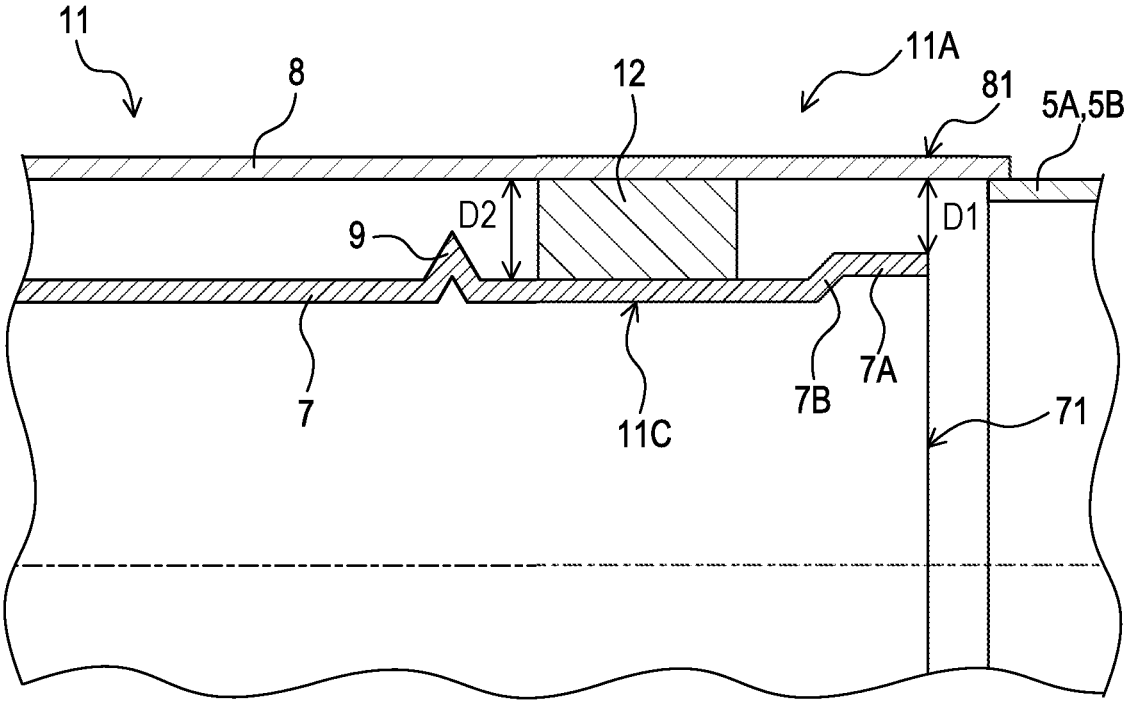
FIG. 4A is a partially enlarged schematic sectional view showing a vicinity of a first end of the exhaust pipe in FIG. 2B.

As shown in FIG. 4A, at the first end 11A where the retention member 12 of the double pipe 11 is disposed, a radial first clearance D1 is provided along the first opening 71 of the inner pipe 7 between the outer circumferential surface of the inner pipe 7 and the inner circumferential surface of the outer pipe 8. The first clearance D1 is smaller than a radial second clearance D2 in an arrangement area 11C where the retention member 12 is disposed.

In other words, the first clearance D1 is smaller than the thickness of the retention member 12 in the radial direction of the double pipe 11. This inhibits the retention member 12 from falling off the first end 11A of the double pipe 11.

In the present embodiment, at the first end 11A, the outer diameter of the inner pipe 7 at the first opening 71 is larger than the outer diameter of the inner pipe 7 in the arrangement area 11C where the retention member 12 is disposed. In the arrangement area 11C, the outer diameter of the inner pipe 7 and the inner diameter of the outer pipe 8 are constant.

In the present embodiment, the diameter of the inner pipe 7 is increased on the outer side of the arrangement area 11C of the first end 11A, thereby making the first clearance D1 smaller than the second clearance D2. The inner pipe 7 further comprises a straight portion 7A and an enlarged diameter portion 7B. The straight portion 7A extends parallel to the outer pipe 8 after the increase in diameter of inner pipe 7 and reaches the first opening 71. The enlarged diameter portion 7B is formed between the arrangement area 11C and the straight portion 7A. It is desirable that the enlarged diameter portion 7B is shaped such that the diameter thereof is gradually increased toward the straight portion 7A, but may be shaped so as to be bent in a step-by-step manner and connected to the straight portion 7A.

To increase the diameter of the inner pipe 7, an outer die and a conical center die can be used, for example. The outer die includes several separate pieces formed by circumferentially dividing a cylindrical body, which has a constant outer diameter and an inner diameter reduced along the axial direction. First, the outer die is inserted into the inner pipe 7 in the axial direction, and the center die is inserted into a hollow portion of the inserted outer die in the axial direction from the small-diameter side. The inner pipe 7 is thereby expanded radially outward so as to form the straight portion 7A and the enlarged diameter portion 7B.

If at least one projection is provided on the outer circumferential surfaces of the divided pieces, at least one projection 9 can be concurrently formed on the inner pipe 7 when the inner pipe 7 is expanded.

[1-2. Operation]

In a case where the first end 11A of the double pipe 11 is located on the upstream side of the exhaust pipe 3, the exhaust gases flowing from the first pipe 5A to the double pipe 11 enter the inner pipe 7 and the gap between the inner pipe 7 and the outer pipe 8. By making the first clearance D1 between the inner pipe 7 and the outer pipe 8 small, the exhaust gases tend to flow into the inner pipe 7 rather than into the gap between the inner pipe 7 and the outer pipe 8.

The exhaust gases flowing in the inner pipe 7 pass through the straight portion 7A and flow to the enlarged diameter portion 7B. The exhaust gases passing through the enlarged diameter portion 7B is facilitated to flow along the shape of the enlarged diameter portion 7B toward radially inside of the inner pipe 7, in other words, toward the axial center of the inner pipe 7. Accordingly, the exhaust gases pass through the inside of the inner pipe 7, and flow from the second opening 72 of the inner pipe 7 to the second pipe 5B through the second end 82 of the outer pipe 8.

At the second end 11B located on the downstream side of the double pipe 11, the resonance pipes 10B respectively having openings on the downstream side are formed, and the resonance chamber 10A coupled with the openings of the resonance pipes 10B on the upstream side is further formed. Thus, noises are muffled due to the Helmholtz resonance.

At the first end 11A of the double pipe 11, the exhaust gases cannot easily enter the gap between the inner pipe 7 and the outer pipe 8, as described above, because the first clearance D1 between the inner pipe 7 and the outer pipe 8 is smaller than the second clearance D2. The exhaust gases, therefore, are less likely to contact the retention member 12.

On the other hand, in a case where the first end 11A of the double pipe 11 is located on the downstream side of the exhaust pipe 3, the exhaust gases flowing from the first pipe 5A to the double pipe 11 enter the inside of the inner pipe 7 and the gap between the inner pipe 7 and the outer pipe 8, that is, the resonance pipes 10B. Due to the resonance pipes 10B being formed in portions of the inner pipe 7 and the outer pipe 8 in the circumferential direction, the cross-sections of the resonance pipes 10B are narrower than other areas of the double pipe 11. The exhaust gases, thus, tend to flow into the inner pipe 7 rather than into the resonance pipes 10B.

The exhaust gases flowing in the inner pipe 7 spread radially outward in the enlarged diameter portion 7B of the inner pipe 7 along the shape of the enlarged diameter portion 7B, and flow toward the downstream side of the straight portion 7A. On the downstream side of the straight portion 7A and at the first end 81 of the outer pipe 8, the exhaust gases spread radially outward and flow toward the second pipe 5B. On the other hand, the exhaust gases flowing through the resonance pipes 10B enter the resonance chamber 10A.

The resonance pipes 10B are formed on the upstream side of the double pipe 11, and the resonance chamber 10A coupled with the openings on the downstream side of the resonance pipes 10B is formed. Thus, noises are muffled due to the Helmholtz resonance.

[1-3. Effect]

The following effects are achieved by the embodiment described in detail hereinabove.

(1*a*) Due to the first clearance D1 between the inner pipe 7 and the outer pipe 8 at the first opening 71 of the inner pipe 7 being smaller than the second clearance D2 in the arrangement area 11C where the retention member 12 is disposed, the retention member 12 can be inhibited from falling off the first end 11A of the double pipe 11. This structure can also reduce the difference in level in the radial direction between the inner pipe 7 and the outer pipe 8 at the first end 11A of the double pipe 11. Accordingly, while having the retention member 12 in the double pipe 11, generation of the turbulent flow of the exhaust gases can be reduced, which in turn reduces the production of the air flow noises.

(1*b*) In a case where the first end 11A of the double pipe 11 is located on the downstream side of the exhaust pipe 3, the exhaust gases that have flown through the inner pipe 7 spread in accordance with the size of the inner diameter at the end of the inner pipe 7 and also spread inside of the first end 81 of the outer pipe 8. Thus, the exhaust gases are unlikely to accumulate around the first opening 71, which in turn limits an increase in pressure loss of the exhaust gases.

(1*c*) Due to the first clearance D1 between the inner pipe 7 and the outer pipe 8 at the first opening 71 of the inner pipe 7 being smaller than the second clearance D2 in the arrangement area 11C where the retention member 12 is arranged, the exhaust gases are less likely to strike the retention member 12. As a result, deterioration of the retention member 12 can be inhibited.

(1*d*) The resonance pipes 10B are formed in the double pipe 11, and the resonance chamber 10A is formed between the retention member 12 and the resonance pipes 10B. Thus, generation of the turbulent flow of the exhaust gases can be reduced in the double pipe 11 that comprises the Helmholtz resonator. Moreover, the enlarged diameter portion 7B located at the end of the inner pipe 7 serves also as a stopper that limits the outward movement of the retention member 12, which forms a portion of the wall of the resonance chamber 10A, in the axial direction of the inner pipe 7.

2. Second Embodiment

[2-1. Structure]

An exhaust pipe according to a second embodiment has the same structure as that of the exhaust pipe 3 according to the first embodiment, except for the structure of the first end 11A.

Similarly to the first embodiment, at the first end 11A in the second embodiment, the first clearance D1 between the inner pipe 7 and the outer pipe 8 at the first opening 71 of the inner pipe 7 is smaller than the second clearance D2 in the arrangement area 11C where the retention member 12 is disposed.

Figure 4B:
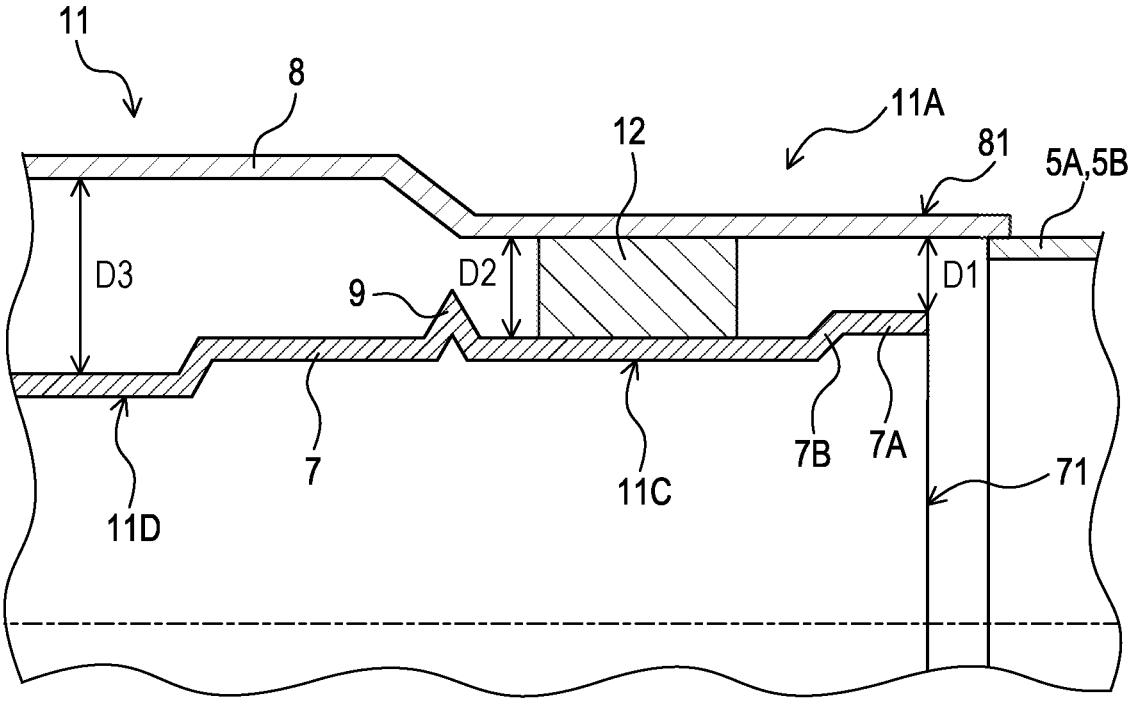
FIG. 4B is a partially enlarged schematic sectional view showing a vicinity of a first end of an exhaust pipe according to an embodiment that is different from the exhaust pipe in FIG. 4A.

Moreover, at the first end 11A, a third clearance D3 is larger than the second clearance D2 in the arrangement area 11C as shown in FIG. 4B. The third clearance D3 is located between the inner pipe 7 and the outer pipe 8 in an inside area 11D located inside relative to the arrangement area 11C where the retention member 12 is disposed.

Specifically, the outer diameter of the inner pipe 7 in the arrangement area 11C is larger than the outer diameter of the inner pipe 7 in the inside area 11D. In other words, the diameter of the inner pipe 7 increases from the inside area 11D toward the arrangement area 11C and further increases from the arrangement area 11C toward the first opening 71.

The inner diameter of the outer pipe 8 in the arrangement area 11C is smaller than the inner diameter of the outer pipe 8 in the inside area 11D. In other words, the diameter of the outer pipe 8 decreases from the inside area 11D toward the arrangement area 11C.

[2-2. Effect]

The following effects are achieved by the embodiment described in detail hereinabove.

(2*a*) The multi-step increase in diameter of the inner pipe 7 enables reduction of the turbulent flow generated at each enlarged diameter portion, which in turn enables more reliable reduction of the turbulent flow of the exhaust gases generated in the entire double pipe 11.

(2*b*) The increase in diameter of the inner pipe 7 in the arrangement area 11C can inhibit the inner pipe 7 from being crushed (in other words, flattened) when the projections 9 are formed. Moreover, due to the reduction in diameter of the outer pipe 8 in the arrangement area 11C, the gap between the retention member 12 and the inner pipe 7 and the outer pipe 8 can be narrowed.

3. Other Embodiments

The embodiments of the present disclosure have been described hereinabove. Nevertheless, it goes without saying that the present disclosure is not limited to the aforementioned embodiments and may be embodied in various forms.

Figure 5A:
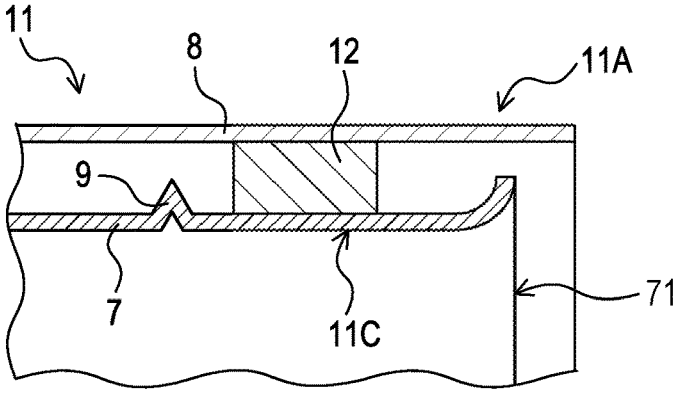
FIG. 5A is a partially enlarged schematic sectional view showing a vicinity of a first end of an exhaust pipe according to an embodiment that is different from the exhaust pipes in FIGS. 4A and 4B.

(3*a*) As shown in FIG. 5A, the exhaust pipe 3 according to the aforementioned embodiments may be configured such that the end of the inner pipe 7 including the first opening 71 is formed into a flared shape. In other words, the inner pipe 7 may be configured without any straight portion that extends in parallel to the outer pipe 8 after an increase of the diameter, and may be formed in a shape in which the cross-sectional area of the inner pipe 7 increases toward the edge of the end portion. The flared shape can be formed by pressing the end of the inner pipe 7 in the axial direction.

Figure 5B:
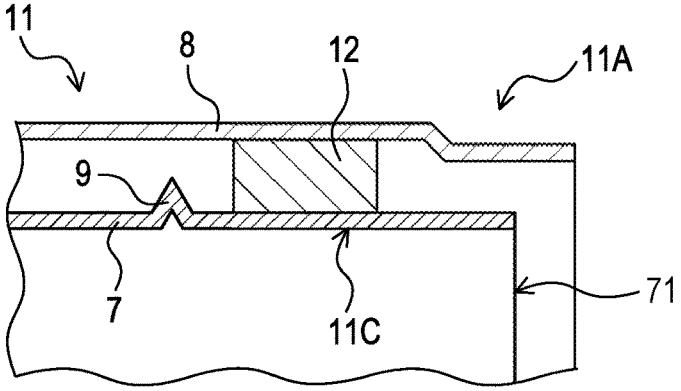
FIG. 5B is a partially enlarged schematic sectional view showing a vicinity of a first end of an exhaust pipe according to an embodiment that is different from the exhaust pipes in FIGS. 4A, 4B, and 5A.

(3*b*) As shown in FIG. 5B, the exhaust pipe 3 according to the aforementioned embodiments may be configured such that the inner diameter of the outer pipe 8 in an area of the double pipe 11 in which the outer pipe 8 coexists with the first opening 71 of the inner pipe 7 is smaller than the inner diameter of the outer pipe 8 in the arrangement area 11C.

Figure 5C:
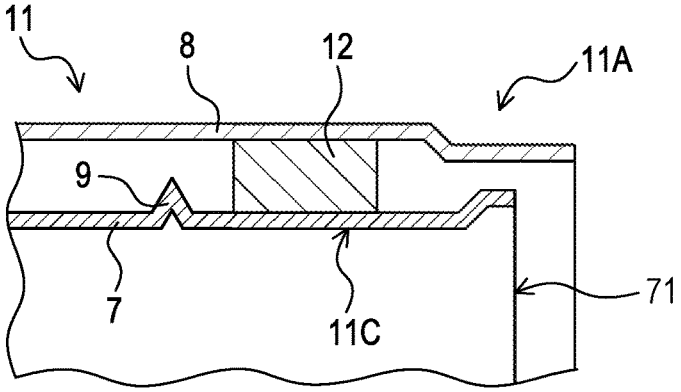
FIG. 5C is a partially enlarged schematic sectional view showing a vicinity of a first end of an exhaust pipe according to an embodiment that is different from the exhaust pipes in FIGS. 4A, 4B, 5A, and 5B.

In other words, the diameter of the outer pipe 8 may be reduced on the outside relative to the arrangement area 11C in the first end 11A. Alternatively, as shown in FIG. 5C, a combination of the increase of the diameter of the inner pipe 7 and the reduction of the diameter of the outer pipe 8 may be employed. In the examples shown in FIGS. 5B and 5C, the amount of increase in diameter of the inner pipe 7, in other words, change in cross-sectional area of the inner pipe 7 is none or small. This can further reduce the turbulent flow.

Figure 5D:
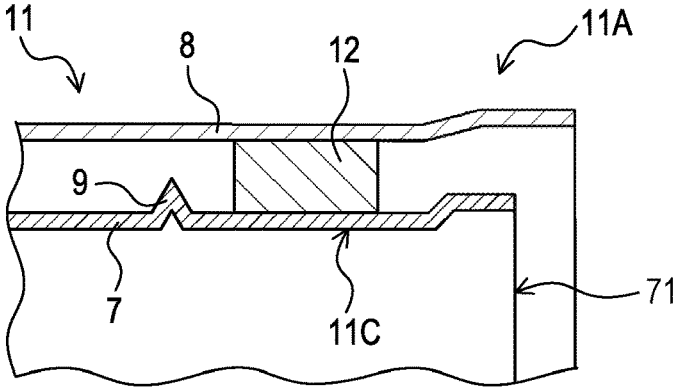
FIG. 5D is a partially enlarged schematic sectional view showing a vicinity of a first end of an exhaust pipe according to an embodiment that is different from the exhaust pipes in FIGS. 4A, 4B, 5A, 5B, and 5C.
Figure 6A:
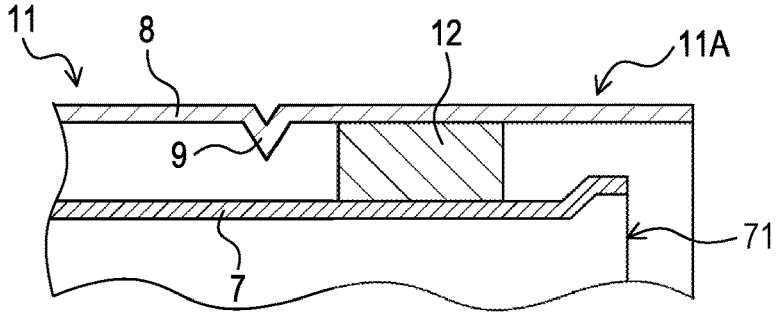
FIG. 6A is a partially enlarged schematic sectional view showing a vicinity of a first end of an exhaust pipe according to an embodiment that is different from the exhaust pipes in FIGS. 4A, 4B, 5A, 5B, 5C, and 5D.
Figure 6B:
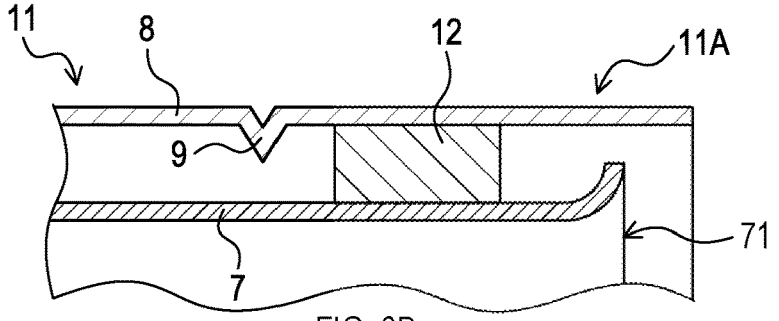
FIG. 6B is a partially enlarged schematic sectional view showing a vicinity of a first end of an exhaust pipe according to an embodiment that is different from the exhaust pipes in FIGS. 4A, 4B, 5A, 5B, 5C, 5D and 6A.
Figure 6C:
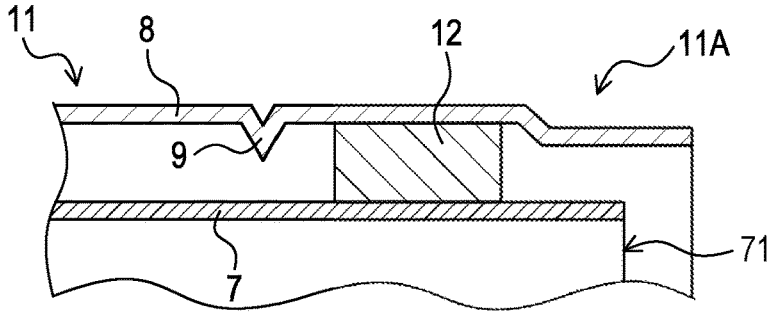
FIG. 6C is a partially enlarged schematic sectional view showing a vicinity of a first end of an exhaust pipe according to an embodiment that is different from the exhaust pipes in FIGS. 4A, 4B, 5A, 5B, 5C, 5D, 6A, and 6B.
Figure 6D:
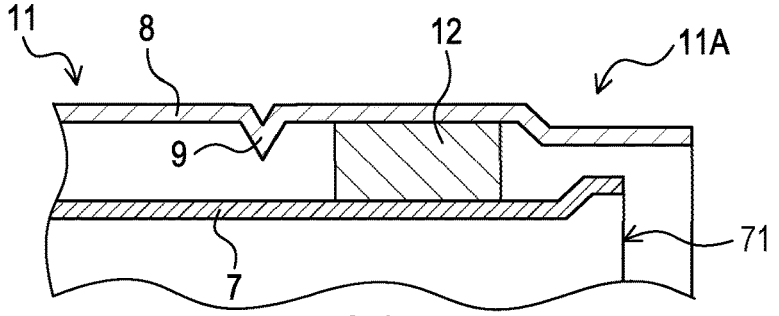
FIG. 6D is a partially enlarged schematic sectional view showing a vicinity of a first end of an exhaust pipe according to an embodiment that is different from the exhaust pipes in FIGS. 4A, 4B, 5A, 5B, 5C, 5D, 6A, 6B, and 6C.
Figure 6E:
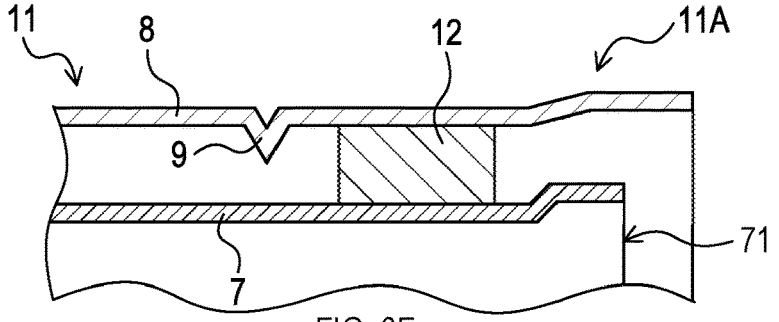
FIG. 6E is a partially enlarged schematic sectional view showing a vicinity of a first end of an exhaust pipe according to an embodiment that is different from the exhaust pipes in FIGS. 4A, 4B, 5A, 5B, 5C, 5D, 6A, 6B, 6C, and 6D.

(3*c*) As shown in FIG. 5D, the exhaust pipe 3 according to the aforementioned embodiments may be configured such that the diameter of the outer pipe 8 is increased at the first end 11A to the extent where the first clearance D1 is kept smaller than the second clearance D2. The increase in diameter of the outer pipe 8 increases the diameter of a joint portion of a pipe to be connected to the first end 11A by, for example, welding, which in turn enhances the joint strength between the pipes.

(3*d*) As shown in FIGS. 6A-6E, the exhaust pipe 3 according to the aforementioned embodiments may be configured such that the projections 9 protrude radially inwardly from the inner circumferential surface of the outer pipe 8. Moreover, the projections 9 may be provided to both of the inner pipe 7 and the outer pipe 8.

(3*e*) In the exhaust pipe 3 according to the aforementioned embodiments, the resonance pipes 10B do not have to be formed. For example, in an exhaust pipe 103 shown in FIG. 7, the outer diameter of an inner pipe 107 at a second end 111B of a double pipe 111 is uniform. In other words, the inner pipe 107 does not have, at a second opening 172, the fixed portion 72A (specifically, the concave portions 72B, 72C) that is fixed to the inner circumferential surface of the outer pipe 8. In the double pipe 111, the resonance chamber 10A is directly led to the exhaust flow passage in the inner pipe 107.

Figure 7:
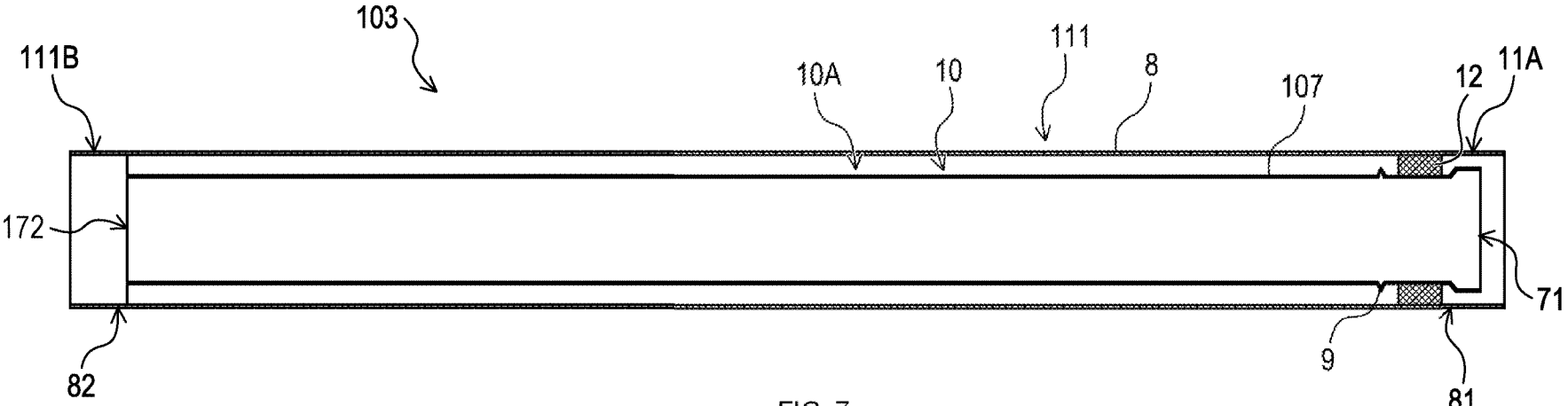
FIG. 7 is a schematic sectional view showing an exhaust pipe according to an embodiment that is different from the exhaust pipe shown in FIGS. 2A and 2B.
Figure 8:
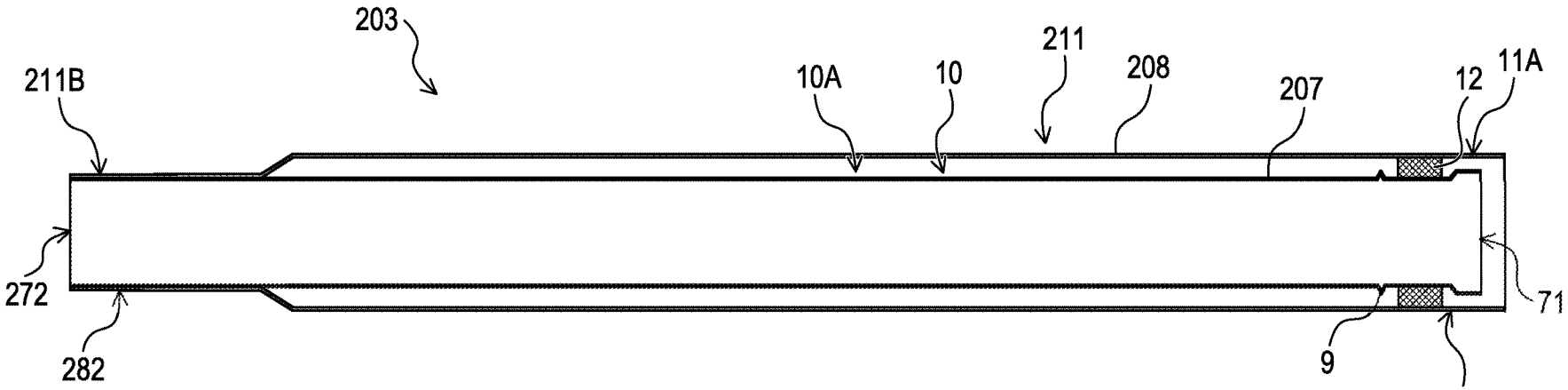
FIG. 8 is a schematic sectional view showing an exhaust pipe according to an embodiment that is different from the exhaust pipes shown in FIGS. 2B, and 7.

For another example, as shown in an exhaust pipe 203 in FIG. 8, the entire circumference of a second end 282 of an outer pipe 208 at a second end 211B of a double pipe 211 may be welded to an inner pipe 207. The inner pipe 207 does not have the concave portions 72B, 72C at a second opening 272. In the double pipe 111 in FIG. 7 and the double pipe 211 in FIG. 8, the resonance chamber 10A serves as a side branch.

Figure 9:
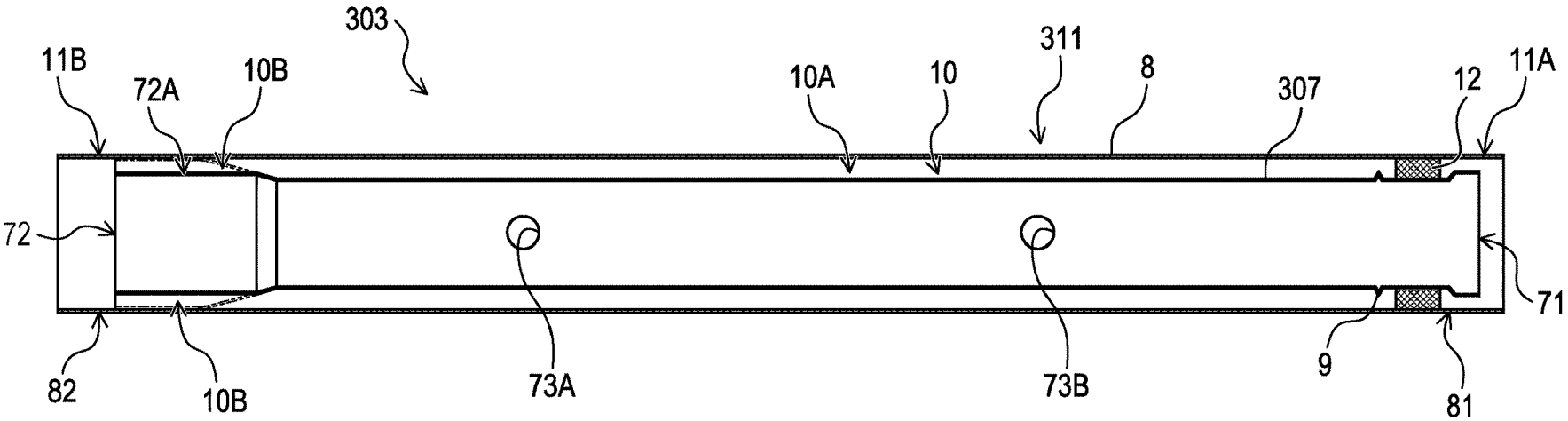
FIG. 9 is a schematic sectional view showing an exhaust pipe according to an embodiment that is different from the exhaust pipes shown in FIGS. 2B, 7, and 8.

(3*f*) In the exhaust pipe 3 according to the aforementioned embodiments, the inner pipe 7 may be provided with one or more communication hole(s). For example, an exhaust pipe 303 shown in FIG. 9 comprises an inner pipe 307 of a double pipe 311 provided with communication holes 73A, 73B for communication between the gap 10 and the inside of the inner pipe 307.

The communication holes 73A, 73B are provided at positions spaced apart from each other in the axial direction (in other words, in the longitudinal direction) of the inner pipe 307. Moreover, the communication holes 73A, 73B are located between the first end 81 and the second end 82 of the outer pipe 8 in the axial direction of the inner pipe 307.

The communication holes 73A, 73B are only required to have enough surface areas for the side branch type muffler to serve its function, but the shapes thereof are not limited to perfect circles. The shapes of the communication holes 73A, 73B may be, for example, ellipses, polygons, rounded polygons, and stars. Moreover, the communication holes 73A, 73B may each comprise separate small holes (in other words, a collection of small holes).

In a case where air column resonance occurs in a second exhaust flow passage (in other words, an exhaust flow passage in the entire exhaust system 1 in FIG. 1) formed by the components of the exhaust flow passage including the exhaust pipe 303, the communication holes 73A, 73B are provided at positions corresponding to the positions of antinodes of the standing wave produce in the second exhaust flow passage.

Moreover, in the exhaust pipe 103 in FIG. 7 or the exhaust pipe 203 in FIG. 8, the communication holes 73A, 73B may be provided to the inner pipe 107 or the inner pipe 207.

(3*g*) The retention member 12 may be provided to at both of the first end 11A and the second end 11B of the double pipe 11. In this case, it is desirable that the first clearance D1 is smaller than the second clearance D2 at both of the first end 11A and the second end 11B.

(3*h*) In the exhaust pipe 3 according to the aforementioned embodiments, the double pipe 11 does not have to have the projections 9.

(3*i*) Functions of one component in the aforementioned embodiments may be distributed to two or more components. Functions of two or more components may be integrated and achieved by one component. A part of the structures of the aforementioned embodiments may be omitted. At least a part of the structures of the aforementioned embodiments may be added to or replaced with other structures of another one of the aforementioned embodiments. It should be noted that any and all modes that are encompassed in the technical ideas identified by the languages in the claims are embodiments of the present disclosure.

What is claimed is:

1. An exhaust pipe comprising:

a double pipe including:

an inner pipe through which exhaust gases pass, the inner pipe including a first enlarged diameter portion and a straight portion; and an outer pipe disposed so as to surround an outer circumferential surface of the inner pipe; and a retention member disposed in a gap provided between the outer circumferential surface of the inner pipe and an inner circumferential surface of the outer pipe, wherein the retention member is disposed at least one of a first end or a second end of the double pipe, wherein, at the at least one of the first end or the second end of the double pipe where the retention member is disposed, a radial clearance between the outer circumferential surface of the inner pipe and the inner circumferential surface of the outer pipe at an opening of the inner pipe is smaller than the radial clearance in an arrangement area where the retention member is disposed, wherein the first enlarged diameter portion is disposed in an area outside of the arrangement area along an axis, a diameter of the first enlarged diameter portion increasing outwardly, and wherein the straight portion directly extends from the first enlarged diameter portion and is formed outside of the first enlarged diameter portion along the axis.

2. The exhaust pipe according to claim 1, wherein, at the at least one of the first end or the second end of the double pipe where the retention member is disposed, an outer diameter of the inner pipe at the opening is larger than an outer diameter of the inner pipe in the arrangement area.

3. The exhaust pipe according to claim 2, wherein, the at least one of the first end or the second end of the double pipe where the retention member is disposed, the outer diameter of the inner pipe in the arrangement area is larger than an outer diameter of the inner pipe in an area located inside relative to the arrangement area along an axis of the inner pipe.

4. The exhaust pipe according to claim 1, wherein, at the at least one of the first end or the second end of the double pipe where the retention member is disposed, an inner diameter of the outer pipe at a position where the outer pipe coexists with an opening of the inner pipe is smaller than an inner diameter of the outer pipe in the arrangement area.

5. The exhaust pipe according to claim 1, wherein the retention member is disposed at a downstream end of the double pipe in a flow direction of the exhaust gases, wherein resonance pipes are formed on an upstream side of the double pipe in the flow direction of the exhaust gases, and wherein a resonance chamber is formed between the retention member and the resonance pipes.

6. The exhaust pipe according to claim 1, wherein the retention member is disposed at an upstream end of the double pipe in a flow direction of the exhaust gases, wherein resonance pipes are formed on a downstream side of the double pipe in the flow direction of the exhaust gases, and wherein a resonance chamber is formed between the retention member and the resonance pipes.

7. The exhaust pipe according to claim 1, wherein the outer pipe includes a second enlarged diameter portion disposed in an area outside of the arrangement area.

8. The exhaust pipe according to claim 1, further comprising:

projections protruding radially outwardly from the outer circumferential surface of the inner pipe and restricting inward movement of the retention member, wherein the projections are spaced apart from each other in a circumferential direction of the inner pipe.

9. The exhaust pipe according to claim 1, further comprising:

projections protruding radially inwardly from the inner circumferential surface of the outer pipe and restricting inward movement of the retention member.

* * * * *